US011721877B2

(12) United States Patent
Hiratsuka et al.

(10) Patent No.: US 11,721,877 B2
(45) Date of Patent: Aug. 8, 2023

(54) RESONATOR PARALLEL-COUPLED FILTER AND COMMUNICATION DEVICE

(71) Applicant: Murata Manufacturing Co., Ltd., Kyoto (JP)

(72) Inventors: Toshiro Hiratsuka, Kyoto (JP); Yoshinori Taguchi, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 323 days.

(21) Appl. No.: 17/211,034

(22) Filed: Mar. 24, 2021

(65) Prior Publication Data

US 2021/0210828 A1 Jul. 8, 2021

Related U.S. Application Data

(63) Continuation of application No. PCT/JP2019/035690, filed on Sep. 11, 2019.

(30) Foreign Application Priority Data

Sep. 28, 2018 (JP) ..... 2018-184390

(51) Int. Cl.
*H01P 1/20* (2006.01)
*H01P 3/08* (2006.01)

(52) U.S. Cl.
CPC . *H01P 1/20* (2013.01); *H01P 3/08* (2013.01)

(58) Field of Classification Search
CPC ..... H01P 1/20; H01P 3/08
See application file for complete search history.

(56) References Cited

U.S. PATENT DOCUMENTS 6,177,853 B1 1/2001 Nagatomi et al.
2004/0257174 A1* 12/2004 Amano ..... H01P 1/20381 333/204
2005/0285701 A1 12/2005 Kayano et al.

FOREIGN PATENT DOCUMENTS

JP 132703/1992 U 12/1992
JP H08-237003 A 9/1996
JP 2006-014068 A 1/2006
WO 98/31066 A1 7/1998

OTHER PUBLICATIONS

International Search Report for International Patent Application No. PCT/JP2019/035690 dated Oct. 8, 2019.
Written Opinion for International Patent Application No. PCT/JP2019/035690 dated Oct. 8, 2019.

(Continued)

*Primary Examiner* — Samuel S Outten
(74) *Attorney, Agent, or Firm* — Pearne & Gordon LLP

(57) ABSTRACT

A first end of a linear conductor of a resonator is connected to a ground conductor on a first surface of a dielectric substrate through a via. A second end of the linear conductor of the resonator is left open. A first end of a linear conductor of a resonator is connected to a ground conductor on a second surface of the dielectric substrate through a via. A second end of the linear conductor of the resonator is left open. An input-output line is connected to the ground conductor on the second surface of the dielectric substrate through a via. An input-output line is opposed to the second ends of the linear conductor of the two resonators.

6 Claims, 9 Drawing Sheets

(56) References Cited

OTHER PUBLICATIONS

Ohira, Masataka et al., "A Novel Microstrip Filter Structure Consisting of Transversal Resonator Array and Its Fully Canonical Bandpass Filter Design", IEEE MTT-S International Microwave Symposium, 2015, pp. 1-4, IEEE, Japan.
Kato, Toshiki et al., "A Microstrip Bandpass Filter with Transmission Zeros Provided by Transversal Resonator Array", Proceedings of the 2015 IEICE General Conference (Electronics 1), 2015, p. 74, C-2-54, IEICE, Japan.

* cited by examiner

RESONATOR PARALLEL-COUPLED FILTER AND COMMUNICATION DEVICE

CROSS REFERENCE TO RELATED APPLICATIONS

This is a continuation of International Application No. PCT/JP2019/035690 filed on Sep. 11, 2019 which claims priority from Japanese Patent Application No. 2018-184390 filed on Sep. 28, 2018. The contents of these applications are incorporated herein by reference in their entireties.

BACKGROUND OF THE DISCLOSURE

Field of the Disclosure

The present disclosure relates to a resonator parallel-coupled filter and a communication device that are suitably used for electromagnetic waves of radio frequencies (called radio frequency signals), such as microwaves and millimeter waves, for example.

Description of the Related Art

There is known a resonator parallel-coupled filter in which a plurality of resonators formed of linear conductors are coupled in parallel (Patent Document 1). In the case of using a TEM resonator such as a strip resonator or a microstrip resonator, for example, the resonators for use in the resonator parallel-coupled filter are basically each constituted by a ½-wavelength resonator of which both ends are short-circuited or left open.

Patent Document 1: Japanese Unexamined Patent Application Publication No. 2006-14068

BRIEF SUMMARY OF THE DISCLOSURE

When the resonator parallel-coupled filter is constituted using the ½-wavelength resonators, each of the resonators is required to have a length equal to a ½ wavelength in a usage band. This gives rise to a problem that a resonator size increases.

An object of an embodiment of the present disclosure is to provide a resonator parallel-coupled filter and a communication device each of which can realize size reduction.

An embodiment of the present disclosure resides in a resonator parallel-coupled filter including a dielectric substrate, ground conductors disposed respectively on a first surface and a second surface of the dielectric substrate, a first resonator including a linear conductor disposed inside the dielectric substrate, a second resonator including a linear conductor disposed inside the dielectric substrate, and a first input-output line and a second input-output line which connect the first resonator and the second resonator to external circuits and to which the first resonator and the second resonator are connected in parallel, wherein the linear conductor of the first resonator has a first end connected to the ground conductor on the first surface of the dielectric substrate through a first via, and a second end being open, the linear conductor of the second resonator has a first end connected to the ground conductor on the second surface of the dielectric substrate through a second via, and a second end being open, the first input-output line is connected to the ground conductor on one of the first surface and the second surface of the dielectric substrate through a third via and is coupled to the first end of the linear conductor of the first resonator and the first end of the linear conductor of the second resonator, and the second input-output line is opposed to the second end of the linear conductor of the first resonator and the second end of the linear conductor of the second resonator and is coupled to the second end of the linear conductor of the first resonator and the second end of the linear conductor of the second resonator.

According to the embodiment of the present disclosure, the sizes of the resonator parallel-coupled filter and the communication device can be reduced.

DETAILED DESCRIPTION OF THE DISCLOSURE

Figure 1:
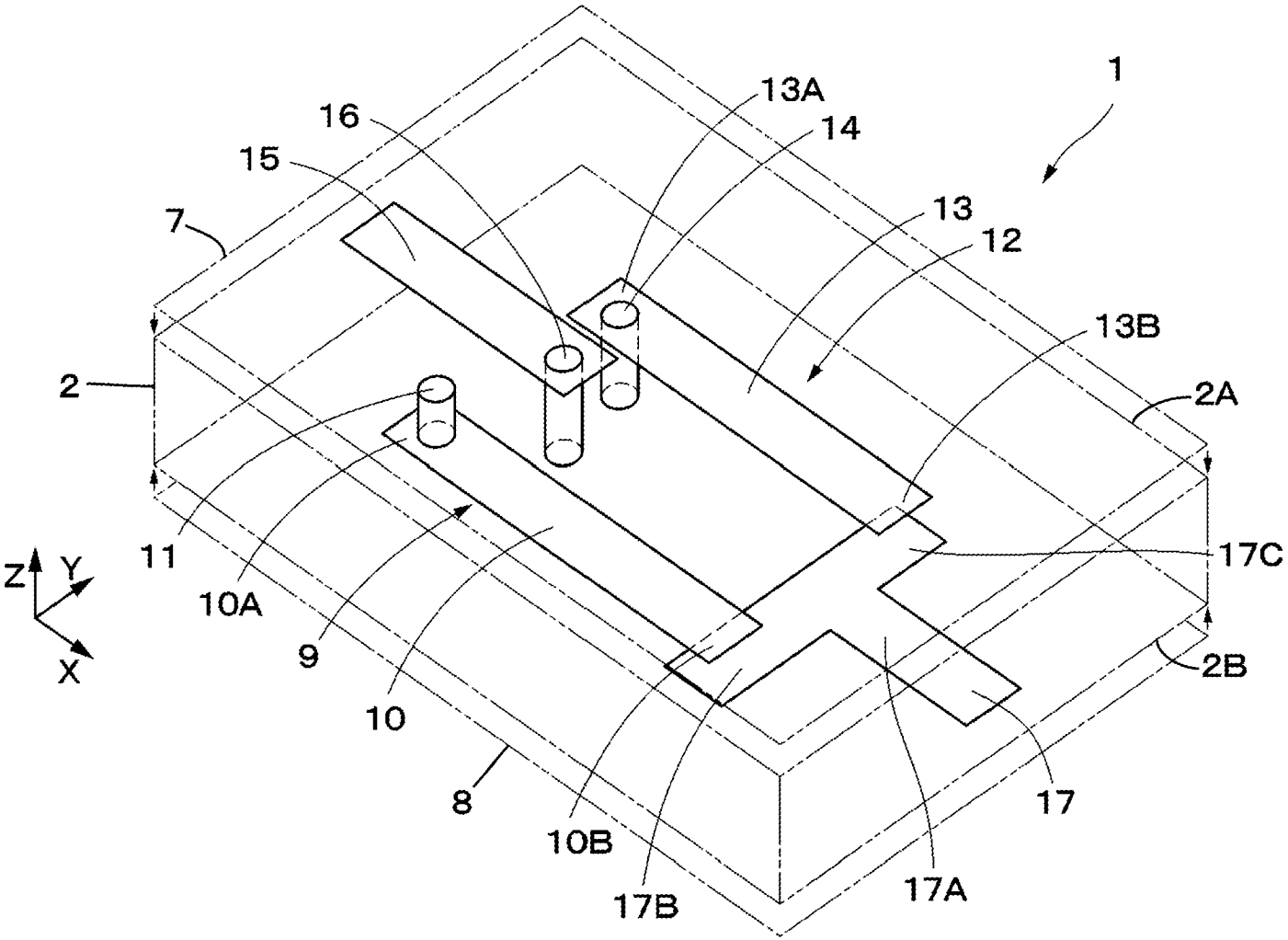
FIG. 1 is a perspective view of a resonator parallel-coupled filter according to a first embodiment of the present disclosure.

A resonator parallel-coupled filter and a communication device according to embodiments of the present disclosure will be described in detail below with reference to the accompanying drawings.

FIGS. 1 to 5 illustrate a resonator parallel-coupled filter 1 according to a first embodiment of the present disclosure. The resonator parallel-coupled filter 1 includes a dielectric substrate 2, ground conductors 7 and 8, resonators 9 and 12, and input-output lines 15 and 17.

The dielectric substrate 2 is in the form of a flat plate extending parallel to two directions among an X-axis direction, a Y-axis direction, and a Z-axis direction orthogonal to one another, for example, the X-axis direction and the Y-axis direction. The dielectric substrate 2 is formed as, for example, a low temperature co-fired ceramic multilayer substrate (LTCC multilayer substrate). The dielectric substrate 2 includes four insulating layers 3 to 6 (see FIGS. 3 and 4) that are laminated in the Z-axis direction to range from a first surface 2A serving as a first principal surface toward a second surface 2B serving as a second principal surface. Each of the insulating layers 3 to 6 is made of an insulating ceramic material capable of being fired at low temperature of 1000° C. or below and is in the form of a thin layer. The dielectric substrate 2 is not limited to the LTCC multilayer substrate, and it may be a multilayer substrate that is formed by laminating insulating layers made of resin materials, for example. The dielectric substrate 2 may be a multilayer resin substrate that is formed by laminating a plurality of resin layers made of a Liquid Crystal Polymer (LCP) with a lower dielectric constant. The dielectric substrate 2 may be a multilayer resin substrate that is formed by laminating a plurality of resin layers made of a fluorine resin. The dielectric substrate 2 may be a ceramic multilayer substrate other than the LTCC multilayer substrate. Moreover, the dielectric substrate 2 may be a flexible substrate with flexibility, or a rigid substrate with thermal plasticity.

The ground conductors 7 and 8 are made of a conductive metal material such as copper or silver, for example. The ground conductors 7 and 8 may be made of a metal material containing, as a main component, aluminum, gold, or an alloy of such a metal. The ground conductor 7 is disposed on the first surface 2A of the dielectric substrate 2. The ground conductor 8 is disposed on the second surface 2B of the dielectric substrate 2. The ground conductors 7 and 8 are connected to an external ground. Each of the ground conductors 7 and 8 entirely cover the first surface 2A and the second surface 2B of the dielectric substrate 2.

Figure 2:
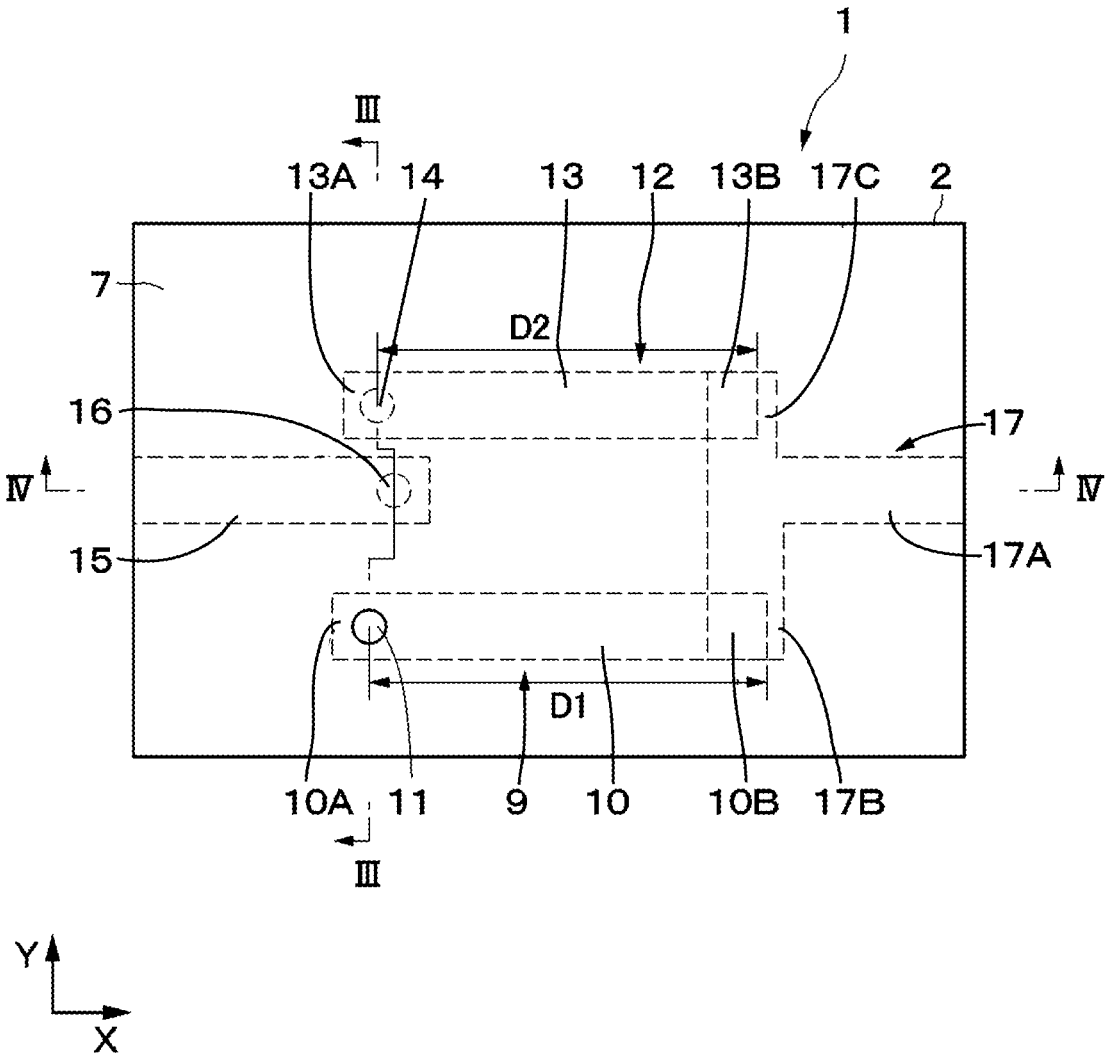
FIG. 2 is a plan view of the resonator parallel-coupled filter illustrated in FIG. 1.
Figure 3:
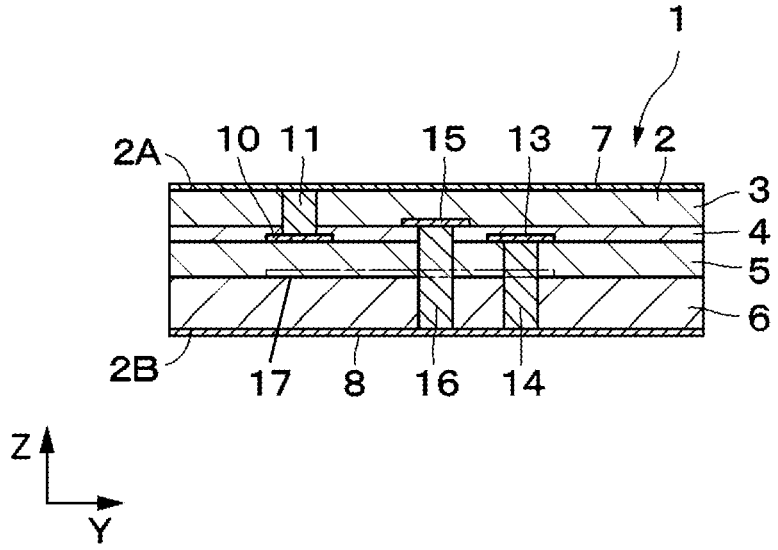
FIG. 3 is a sectional view of the resonator parallel-coupled filter taken along III-III in FIG. 2 and viewed in a direction denoted by arrow.
Figure 4:
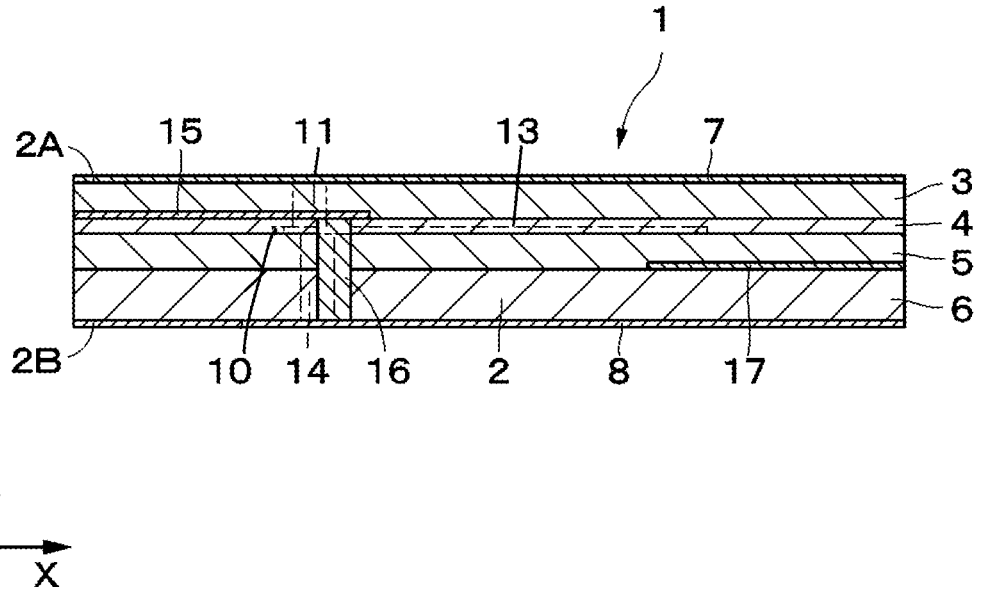
FIG. 4 is a sectional view of the resonator parallel-coupled filter taken along IV-IV in FIG. 2 and viewed in a direction denoted by arrow.

The resonator 9 is disposed inside the dielectric substrate 2 (see FIGS. 1 to 4). The resonator 9 is a first resonator. The resonator 9 includes a linear conductor 10. The linear conductor 10 is positioned between the insulating layer 4 and the insulating layer 5 and is formed in an elongate strip shape extending in the X-axis direction that is a lengthwise direction. As illustrated in FIG. 2, a length D1 of the linear conductor 10 in the X-axis direction is set to ¼ of a wavelength in the dielectric substrate 2 corresponding to a first resonant frequency, for example. The length D1 is a length from a center of a via 11 to a second end 10B of the linear conductor 10. Instead, a size resulting from adding a height of the via 11 to the length D1 may be set to ¼ of the wavelength in the dielectric substrate 2 corresponding to the first resonant frequency. A first end 10A of the linear conductor 10 is positioned on a first end side in the X-axis direction and is connected to the ground conductor 7 on the first surface 2A of the dielectric substrate 2 through the via 11 that serves as a first via. The via 11 is formed by a columnar conductor that extends in a thickness direction of the dielectric substrate 2 (namely, in the Z-axis direction) while penetrating through the insulating layers 3 and 4. The via 11 forms an inductor L11 between the linear conductor 10 and the ground conductor 7 (see FIG. 5). The second end 10B of the linear conductor 10 is positioned on a second end side in the X-axis direction, is covered with the insulating layers 4 and 5, and is left open. Hence the resonator 9 constitutes a ¼-wavelength resonator.

The resonator 12 is disposed inside the dielectric substrate 2 (see FIGS. 1 to 4). The resonator 12 is a second resonator. The resonator 12 includes a linear conductor 13. The linear conductor 13 is positioned between the insulating layer 4 and the insulating layer 5 and is formed in an elongate strip shape extending in the X-axis direction that is the lengthwise direction. The linear conductor 13 is spaced from the linear conductor 10 in the Y-axis direction. The linear conductor 13 extends in the X-axis direction parallel to the linear conductor 10.

As illustrated in FIG. 2, a length D2 of the linear conductor 13 in the X-axis direction is set to ¼ of a wavelength in the dielectric substrate 2 corresponding to a second resonant frequency, for example. The length D2 is a length from a center of a via 14 to a second end 13B of the linear conductor 13. Instead, a size resulting from adding a height of the via 14 to the length D2 may be set to ¼ of the wavelength in the dielectric substrate 2 corresponding to the second resonant frequency. The length D2 of the linear conductor 13 is set to a different value from the length D1 of the linear conductor 10, for example, to a smaller value than the length D1. The length D2 of the linear conductor 13 may be set to a greater value than the length D1 of the linear conductor 10.

A first end 13A of the linear conductor 13 is positioned on the first end side in the X-axis direction and is connected to the ground conductor 8 on the second surface 2B of the dielectric substrate 2 through the via 14 that serves as a second via. The via 14 is formed by a columnar conductor that extends in the thickness direction of the dielectric substrate 2 (namely, in the Z-axis direction) while penetrating through the insulating layers 5 and 6. Furthermore, the via 14 for the resonator 12 and the via 11 for the resonator 9 extend in opposite directions with respect to the thickness direction of the dielectric substrate 2 (namely, in the Z-axis direction) (see FIGS. 1 and 3). The via 14 forms an inductor L12 between the linear conductor 13 and the ground conductor 8 (see FIG. 5). The second end 13B of the linear conductor 13 is positioned on the second end side in the X-axis direction, is covered with the insulating layers 4 and 5, and is left open. Hence the resonator 12 constitutes a ¼-wavelength resonator.

The pair of input-output lines 15 and 17 connect the two resonators 9 and 12 to external circuits, and the two resonators 9 and 12 are connected in parallel between the pair of input-output lines 15 and 17 (see FIGS. 1 to 4). The input-output line 15 is a first input-output line. The input-output line 15 is positioned on the first end side in the X-axis direction and is arranged between the insulating layer 3 and the insulating layer 4. The input-output line 17 is a second input-output line. The input-output line 17 is positioned on the second end side in the X-axis direction and is arranged between the insulating layer 5 and the insulating layer 6.

The input-output line 15 is inserted between the two resonators 9 and 12 in a state not in contact with the two resonators 9 and 12. The input-output line 15 is arranged at a position closer to the first ends 10A and 13A of the linear conductors 10 and 13 of the two resonators 9 and 12 than the second ends 10B and 13B thereof.

The input-output line 15 is connected to the ground conductor 8 on the second surface 2B of the dielectric substrate 2 through a via 16 that serves as a third via. The via 16 is formed by a columnar conductor that extends in the thickness direction of the dielectric substrate 2 (namely, in the Z-axis direction) while penetrating through the insulating layers 4, 5 and 6. The via 16 for the input-output line 15 is arranged at a position different from the vias 11 and 14 for the resonators 9 and 12 in the Y-axis direction and is opposed to the vias 11 and 14 for the resonators 9 and 12. Thus, the via 16 forms not only an inductor L21 coupled to the inductor L11 formed by the via 11, but also an inductor L22 coupled to the inductor L12 formed by the via 14 (see FIG. 5). The inductors L21 and the inductor L22 are connected in series between the input-output line 15 and the ground conductor 8. The input-output line 15 is coupled to the first ends 10A and 13A of the linear conductors 10 and 13 of the two resonators 9 and 12. In the above-described configuration, the coupling between the input-output line 15 and the first ends 10A and 13A of the linear conductors 10 and 13 is mainly magnetic field coupling.

Positional relations between the via 16 and the vias 11 and 14 are set as appropriate depending on desired relations of coupling strength between the input-output line 15 and the two resonators 9 and 12.

The input-/output line 17 is arranged at a position closer to the second ends 10B and 13B of the linear conductors 10 and 13 of the two resonators 9 and 12 than the first ends 10A and 13A thereof (see FIGS. 1 to 4). The input-output line 17 includes a transfer line portion 17A formed in an elongate strip shape extending in the X-axis direction and opposing portions 17A and 17B extending from the transfer line portion 17A toward both sides in the Y-axis direction (widthwise direction). The opposing portions 17B and 17C of the input-output line 17 are opposed respectively to the second ends 10B and 13B of the linear conductors 10 and 13 of the two resonators 9 and 12 in the thickness direction with the insulating layer 5 interposed therebetween. In the above-described configuration, a capacitor C1 is formed between the opposing portion 17B of the input-output line 17 and the second end 10B of the linear conductors 10 of the resonator 9 (see FIG. 5). A capacitor C2 is formed between the opposing portion 17C of the input-output line 17 and the second end 13B of the linear conductors 13 of the resonator and 12. The input-output line 17 is coupled to the second ends 10B and 13B of the linear conductors 10 and 13 of the two resonators 9 and 12. Accordingly, the coupling between the input-output line 17 and the second ends 10B and 13B of the linear conductors 10 and 13 is mainly capacitive coupling.

Figure 5:
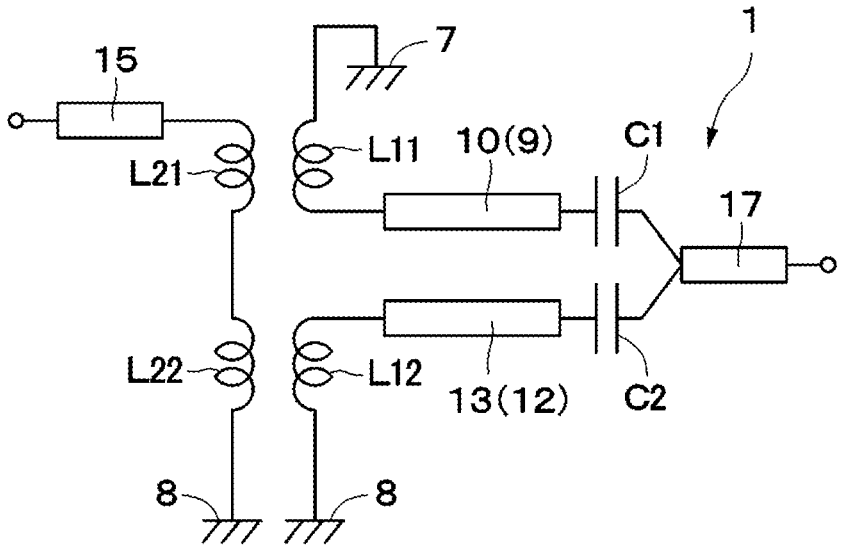
FIG. 5 is an equivalent circuit diagram of the resonator parallel-coupled filter according to the first embodiment.

The connection relations between the two resonators 9 and 12 and the input-output lines 15 and 17 are now described with reference to an equivalent circuit of the resonator parallel-coupled filter 1 illustrated in FIG. 5.

The via 11 for the resonator 9 and the via 14 for the resonator 12 extend in the opposite directions with respect to the thickness direction of the dielectric substrate 2 (namely, in the Z-axis direction). In this configuration, the via 11 forms the inductor L11 between the linear conductor 10 and the ground conductor 7. On the other hand, the via 14 forms the inductor L12 between the linear conductor 13 and the ground conductor 8.

Moreover, the via 16 for the input-output line 15 forms the inductor L21 coupled to the inductor L11 of the via 11 and the inductor L22 coupled to the inductor L12 of the via 14. The inductors L21 and L22 are connected in series between the input-output line 15 and the ground conductor 8. In addition, the capacitors C1 and C2 are formed between the input-output line 17 and the linear conductors 10 and 13 of the resonators 9 and 12, respectively. Thus, the two resonators 9 and 12 are connected in parallel between the pair of input-output lines 15 and 17.

Here, when currents flow through the inductors L12 and L22 in the same direction, currents flow through the inductors L11 and L21 in opposite directions with respect to the ground. Accordingly, the two resonators 9 and 12 are connected in opposite phases between the pair of input-output lines 15 and 17. As a result, the resonator parallel-coupled filter 1 functions as a band pass filter.

Figure 6:
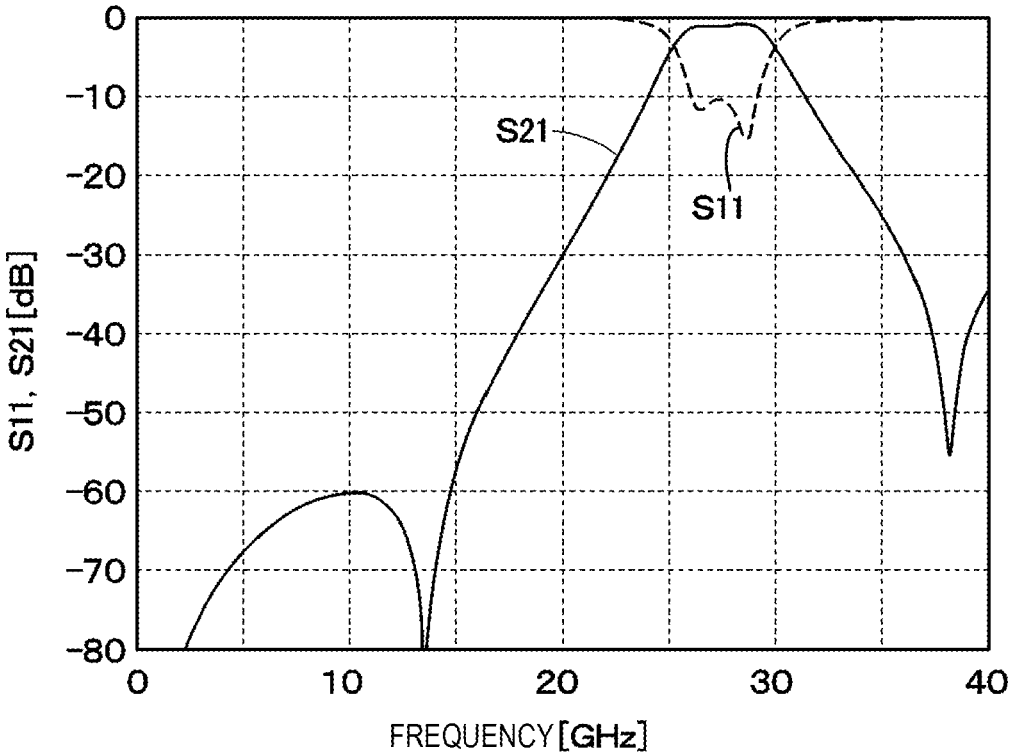
FIG. 6 illustrates characteristic curves representing frequency characteristics of a transmittance coefficient and a reflection coefficient in the resonator parallel-coupled filter according to the first embodiment.
Figure 7:
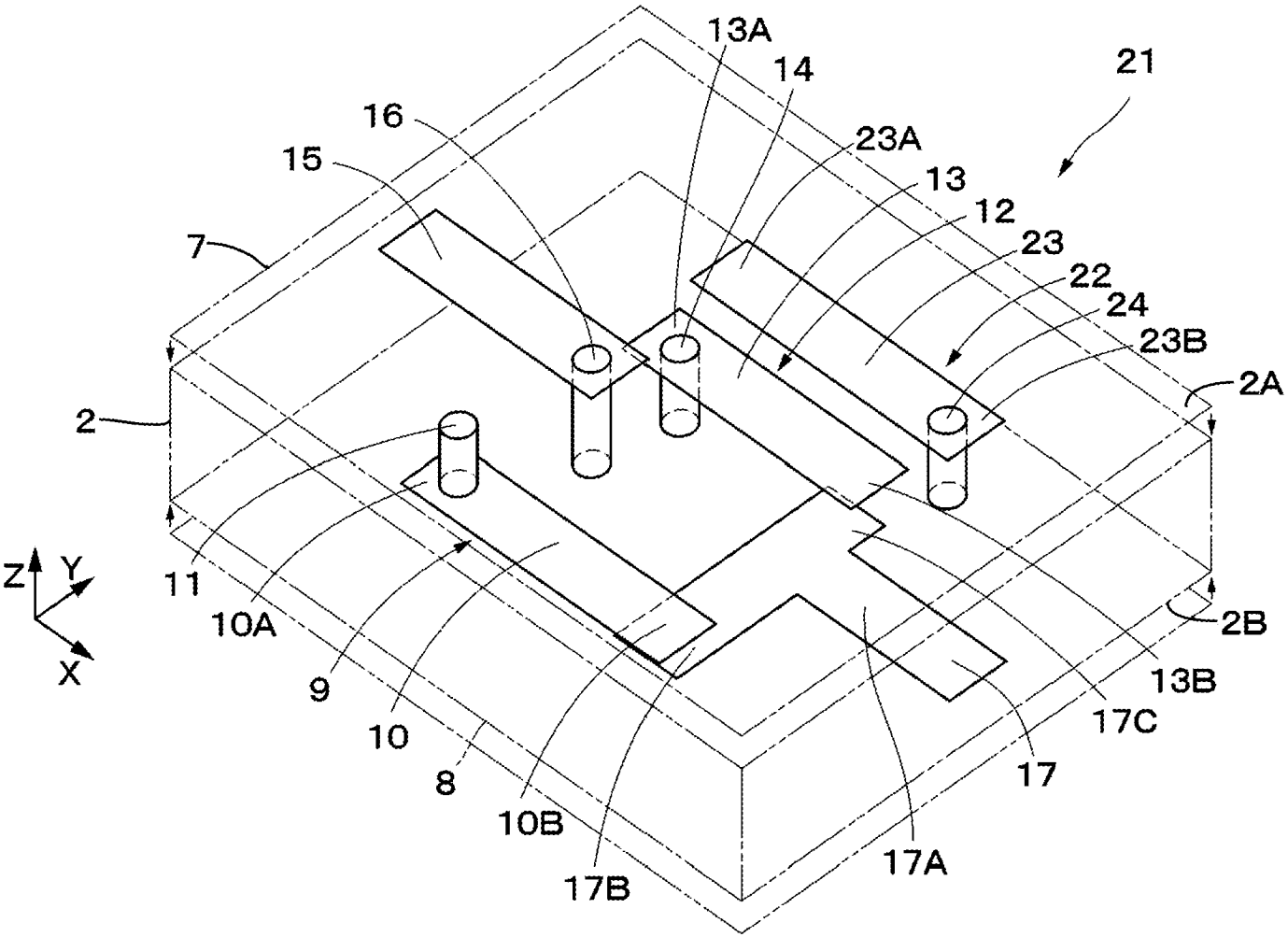
FIG. 7 is a perspective view of a resonator parallel-coupled filter according to a second embodiment of the present disclosure.
Figure 8:
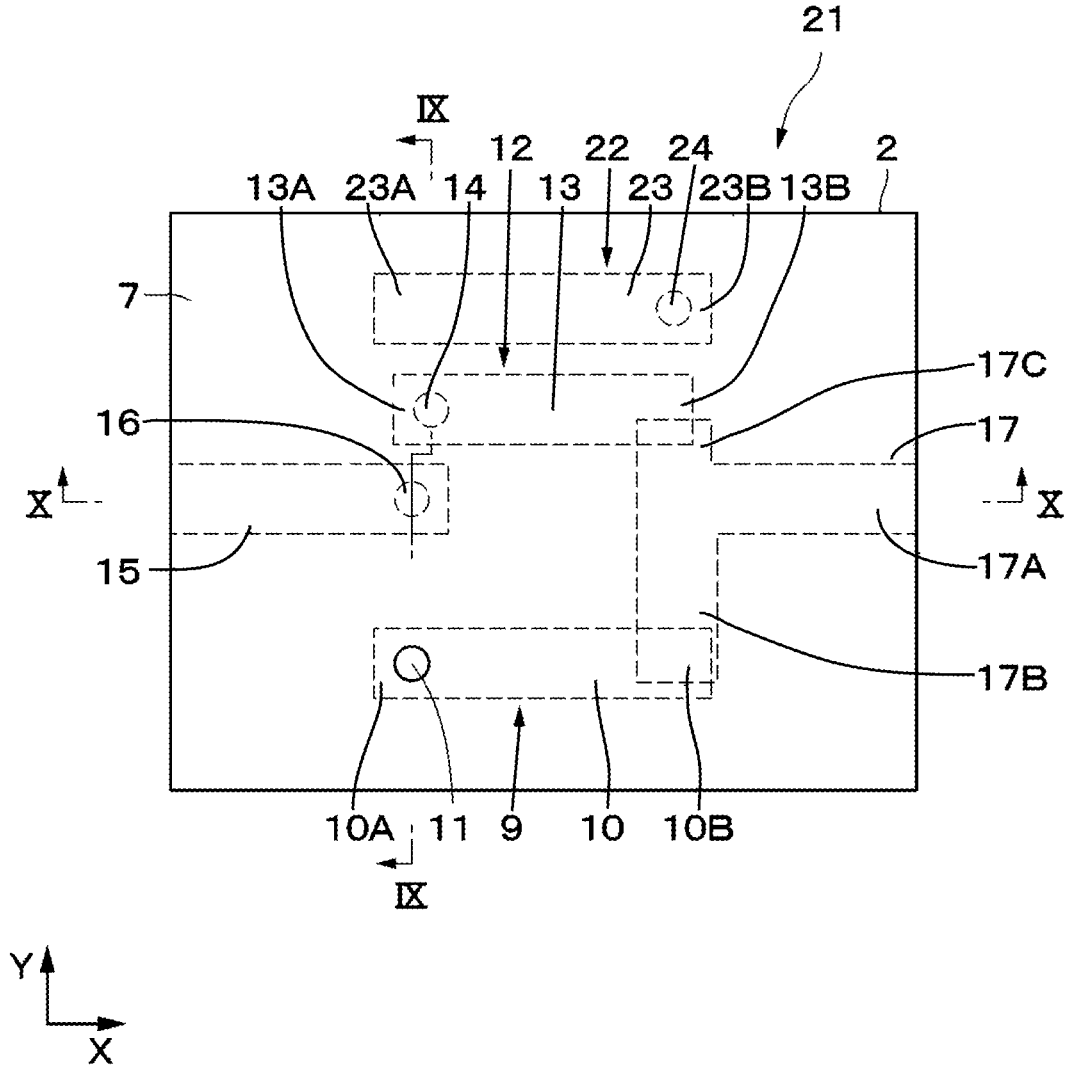
FIG. 8 is a plan view of the resonator parallel-coupled filter illustrated in FIG. 7.
Figure 9:
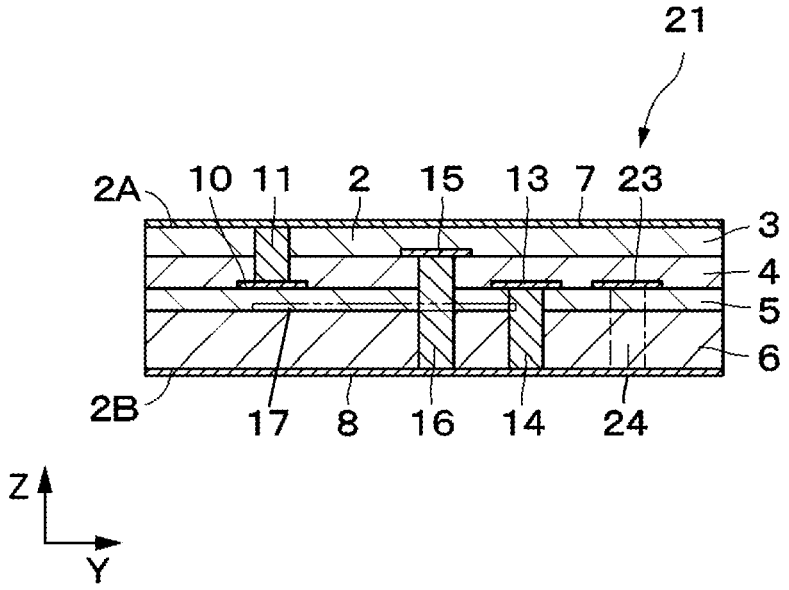
FIG. 9 is a sectional view of the resonator parallel-coupled filter taken along IX-IX in FIG. 8 and viewed in a direction denoted by arrow.
Figure 10:
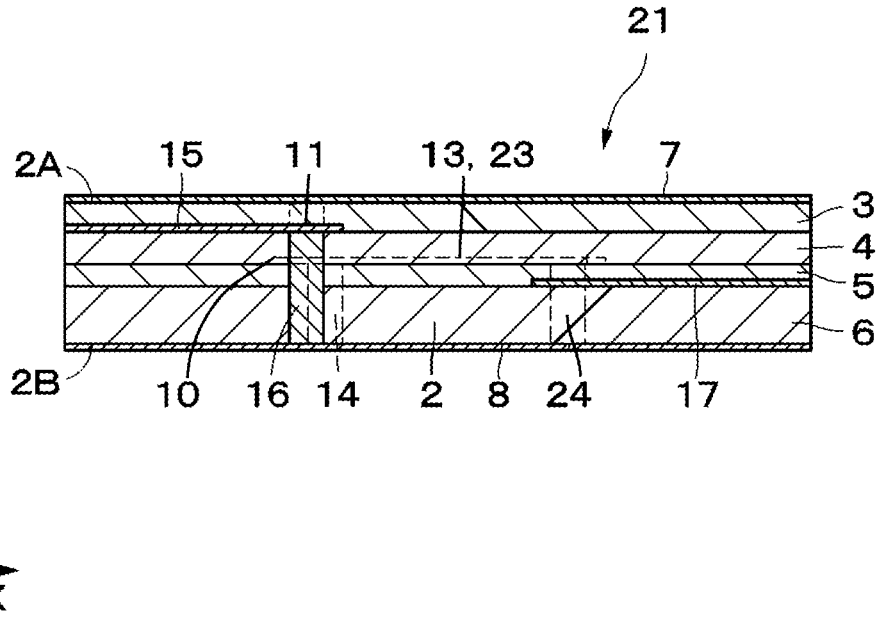
FIG. 10 is a sectional view of the resonator parallel-coupled filter taken along X-X in FIG. 8 and viewed in a direction denoted by arrow.

In order to confirm frequency characteristics of the resonator parallel-coupled filter 1 according to this embodiment, frequency characteristics of S parameters, namely S11 (reflection coefficient) and S21 (transmittance coefficient), are determined by simulations. FIG. 6 illustrates an example of the determined results.

In the resonator parallel-coupled filter 1 according to this embodiment, as illustrated in FIG. 6, the reflection coefficient S11 increases toward a minus direction from 0 dB and the transmittance coefficient S21 comes close to 0 dB near a range of 25 to 30 GHz, namely a pass band. Thus, the resonator parallel-coupled filter 1 allows signals in a band (for example, 25 GHz to 30 GHz) around the resonant frequencies of the two resonators 9 and 12 to pass therethrough.

As described above, the resonator parallel-coupled filter 1 according to this embodiment includes the dielectric substrate 2, the ground conductors 7 and 8 disposed respectively on the first surface 2A and the second surface 2B of the dielectric substrate 2, the resonator 9 including the linear conductor 10 disposed inside the dielectric substrate 2, the resonator 12 including the linear conductor 13 disposed inside the dielectric substrate 2, and the input-output line 15 and the input-output line 17 which connect the resonator 9 and the resonator 12 to the external circuits and to which the resonator 9 and the resonator 12 are connected in parallel.

In addition, the first end 10A of the linear conductor 10 of the resonator 9 is connected to the ground conductor 7 on the first surface 2A of the dielectric substrate 2 through the via 11, and the second end 10B of the linear conductor 10 of the resonator 9 is left open. The first end 13A of the linear conductor 13 of the resonator 12 is connected to the ground conductor 8 on the second surface 2B of the dielectric substrate 2 through the via 14, and the second end 13B of the linear conductor 13 of the resonator 12 is being open. The input-output line 15 is connected to the ground conductor 8 on one of the first surface 2A and the second surface 2B of the dielectric substrate 2 and is coupled to the first end 10A of the linear conductor 10 of the resonator 9 and the first end 13A of the linear conductor 13 of the resonator 12. The input-output line 17 is opposed to the second end 10B of the linear conductor 10 of the resonator 9 and the second end 13B of the linear conductor 13 of the resonator 12 and is coupled to the second end 10B of the linear conductor 10 of the resonator 9 and the second end 13B of the linear conductor 13 of the resonator 12.

With the above-described configuration, the two resonators 9 and 12 operate as ¼-wavelength resonators in which the first ends 10A and 13A of the linear conductors 10 and 13 are connected to the ground conductors 7 and 8, respectively, and the second ends 10B and 13B of the linear conductors 10 and 13 are left open. Furthermore, the input-output line 15 is short-circuited to the ground conductor 8 through the via 16. The via 16 for the input-output line 15 is coupled to the vias 11 and 14 for the two resonators 9 and 12. In this respect, the vias 11 and 14 for the two resonators 9 and 12 extend in the opposite directions with respect to the thickness direction of the dielectric substrate 2 and are connected to the different ground conductors 7 and 8, respectively. Moreover, the second ends 10B and 13B of the linear conductors 10 and 13 of the two resonators 9 and 12 are left open and are coupled to the input-output line 17. Thus, the two resonators 9 and 12 operate as ¼-wavelength resonators and are connected in opposite phases between the input-output line 15 and the input-output line 17. As a result, the resonator parallel-coupled filter 1 allows the radio frequency signals in the band around the resonant frequencies of the resonators 9 and 12 to pass therethrough. In addition, a size of the resonator parallel-coupled filter 1 can be reduced in comparison with the case of using a ½-wavelength resonator.

A second embodiment of the present disclosure will be described below with reference to FIGS. 7 to 10. The second embodiment is featured in including a third resonator that includes a linear conductor disposed inside the dielectric substrate and that is coupled to one of the first resonator and the second resonator. In the second embodiment, the same constituent elements as those in the first embodiment are denoted by the same reference signs, and the description of those constituent elements is omitted.

A resonator parallel-coupled filter 21 according to the second embodiment includes, almost as in the resonator parallel-coupled filter 1 according to the first embodiment, the dielectric substrate 2, the ground conductors 7 and 8, the resonators 9 and 12, and the input-output line 15 and 17. In addition, the resonator parallel-coupled filter 21 includes another resonator 22 that is coupled to the resonator 12.

The resonator 22 is disposed inside the dielectric substrate 2. The resonator 22 is a third resonator. The resonator 22 includes a linear conductor 23. The linear conductor 23 is positioned between the insulating layer 4 and the insulating layer 5 and is formed in an elongate strip shape extending in the X-axis direction that is the lengthwise direction. The linear conductor 23 is spaced from the linear conductor 13 in the Y-axis direction. The linear conductor 23 extends in the X-axis direction parallel to the linear conductor 13.

A length of the linear conductor 23 in the X-axis direction is set to ¼ of a wavelength in the dielectric substrate 2 corresponding to a resonant frequency in a pass band, for example. Here, the length of the linear conductor 23 in the X-axis direction is a length from a center of a via 24 to a first end 23A of the linear conductor 23. Instead, a size resulting from adding a height of the via 24 to the length of the linear conductor 23 in the X-axis direction may be set to ¼ of the wavelength in the dielectric substrate 2 corresponding to the resonant frequency in the pass band. The length of the linear conductor 23 is set to a different value from the length of the linear conductor 13 and, for example, it is set to a greater value than the length of the linear conductor 13. The length of the linear conductor 23 may be set to a smaller value than or the same value as the length of the linear conductor 13.

A first end 23A of the linear conductor 23 is positioned on the first end side in the X-axis direction, is covered with the insulating layers 4 and 5, and is left open. The first end 23A of the linear conductor 23 is arranged at a position closer to the first end 13A of the linear conductor 13 than the second end 13B thereof.

The second end 23B of the linear conductor 23 is positioned on the second end side in the X-axis direction and is connected to the ground conductor 8 on the second surface 2B of the dielectric substrate 2 through the via 24 that serves as a fourth via. The second end 23B of the linear conductor 23 is arranged at a position closer to the second end 13B of the linear conductor 13 than the first end 13A thereof. The via 24 is formed by a columnar conductor that extends in the thickness direction of the dielectric substrate 2 (namely, in the Z-axis direction) while penetrating through the insulating layers 5 and 6. Furthermore, the via 24 for the resonator 22 and the via 14 for the resonator 12 are arranged at positions on opposite sides with respect to a lengthwise direction (X-axis direction) in which the linear conductors 23 and 13 extend. The resonator 22 constitutes a ¼-wavelength resonator.

Furthermore, the linear conductor 23 is arranged on an opposite side to the linear conductor 10 in the Y-axis direction with the linear conductor 13 interposed therebetween. Accordingly, the resonator 22 is not coupled to the resonator 9, but is coupled to the resonator 12. In this case, the coupling between the resonator 22 and the resonator 12 is mainly capacitive coupling.

Thus, the resonator parallel-coupled filter 21 constituted as described above according to the second embodiment can also pass the radio frequency signals in the band around the resonant frequencies of the resonators 9 and 12 therethrough. In addition, a size of the resonator parallel-coupled filter 21 can be reduced in comparison with the case of using a ½-wavelength resonator. Moreover, in the second embodiment, since the resonator 22 is further disposed in the dielectric substrate 2 to be coupled to the resonator 12, a 3-stage Cul-de-Sac coupled filter made up of the three resonators 9, 12 and 22 can be constituted. The 3-stage Cul-de-Sac coupled filter has a coupling configuration including a resonator that is not directly coupled to an input stage and an output stage. In the resonator parallel-coupled filter 21 illustrated in FIG. 7, the resonator 22 is not directly coupled to the input stage and the output stage. As a result, sharper attenuation characteristics can be obtained in comparison with the resonator parallel-coupled filter 1 according to the first embodiment, which is constituted by the two resonators 9 and 12.

In the second embodiment, the resonator 22 serving as the third resonator is coupled to the resonator 12 serving as the second resonator. The present disclosure is not limited to that case, and the third resonator may be coupled to the first resonator.

Figure 11:
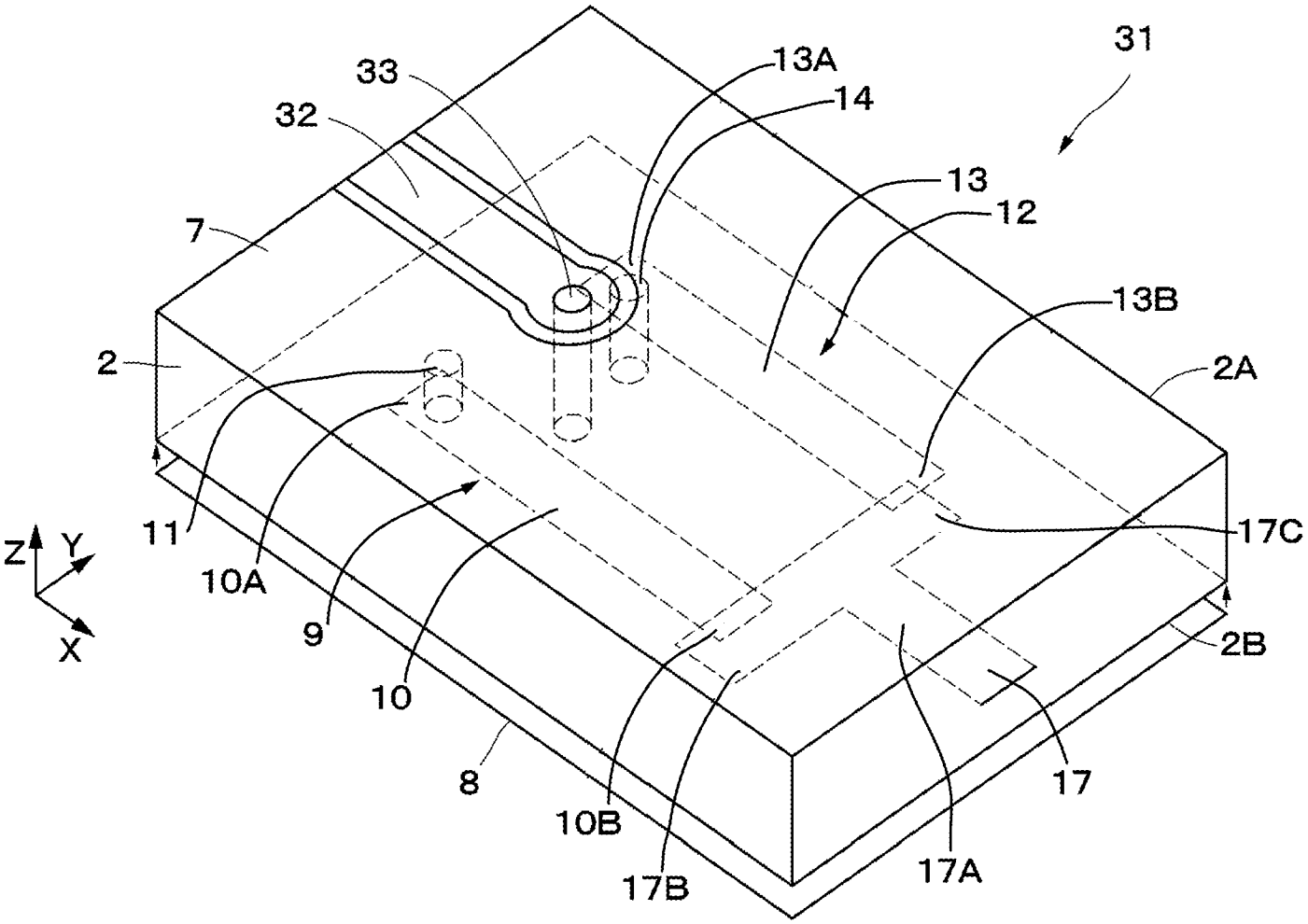
FIG. 11 is a perspective view of a resonator parallel-coupled filter according to a third embodiment of the present disclosure.

A third embodiment of the present disclosure will be described below with reference to FIG. 11. The third embodiment is featured in that one of the pair of input-output lines includes a penetration via penetrating through the dielectric substrate in the thickness direction and connected to the ground conductor on the second surface of the dielectric substrate. In the third embodiment, the same constituent elements as those in the first embodiment are denoted by the same reference signs, and the description of those constituent elements is omitted.

A resonator parallel-coupled filter 31 according to the third embodiment includes, almost as in the resonator parallel-coupled filter 1 according to the first embodiment, the dielectric substrate 2, the ground conductors 7 and 8, the resonators 9 and 12, and a pair of input-output lines 32 and 17.

The pair of input-output lines 32 and 17 connect the two resonators 9 and 12 to the external circuits, and the two resonators 9 and 12 are connected in parallel between the pair of input-output lines 32 and 17. The input-output line 32 is the first input-output line. The input-output line 32 is arranged on the first surface 2A of the dielectric substrate 2 in a state insulated from the ground conductor 7. The input-output line 17 is arranged between the insulating layer 5 and the insulating layer 6.

The input-output line 32 is inserted between the two resonators 9 and 12 in a state not in contact with the two resonators 9 and 12. The input-output line 32 is arranged at a position closer to the first ends 10A and 13A of the linear conductors 10 and 13 of the two resonators 9 and 12 than the second ends 10B and 13B thereof. The input-output line 32 is formed in an elongate strip shape extending in the X-axis direction.

The input-output line 32 is connected to the ground conductor 8 on the second surface 2B of the dielectric substrate 2 through a penetration via 33 that serves as the third via. The penetration via 33 is formed by a columnar conductor that extends in the thickness direction of the dielectric substrate 2 (namely, in the Z-axis direction) while penetrating through the dielectric substrate 2. The penetration via 33 for the input-output line 32 is arranged at a position different from the vias 11 and 14 for the resonators 9 and 12 in the Y-axis direction and is opposed to the vias 11 and 14 for the resonators 9 and 12. Accordingly, the input-output line 32 is coupled to the first ends 10A and 13A of the linear conductors 10 and 13 of the two resonators 9 and 12. In the above-described configuration, the coupling between the input-output line 32 and the first ends 10A and 13A of the linear conductors 10 and 13 is mainly magnetic field coupling.

Thus, the resonator parallel-coupled filter 31 constituted as described above according to the third embodiment can also pass the radio frequency signals in the band around the resonant frequencies of the resonators 9 and 12 therethrough. In addition, a size of the resonator parallel-coupled filter 31 can be reduced in comparison with the case of using a ½-wavelength resonator. Moreover, the input-output line 32 is connected to the ground conductor 8 on the second surface 2B of the dielectric substrate 2 through the penetration via 33. Therefore, the input-output line 32 connected to the external circuit can be arranged on the first surface 2A of the dielectric substrate 2. Accordingly, even when various signal lines are formed inside the dielectric substrate 2, those signal lines do not interfere with the input-output line 32. As a result, a degree of freedom in connection to the external circuit can be increased.

The input-output line 32 may be disposed on the second surface 2B of the dielectric substrate 2. In that case, the input-output line 32 is connected to the ground conductor 7 on the first surface 2A of the dielectric substrate 2 through the penetration via 33.

Figure 12:
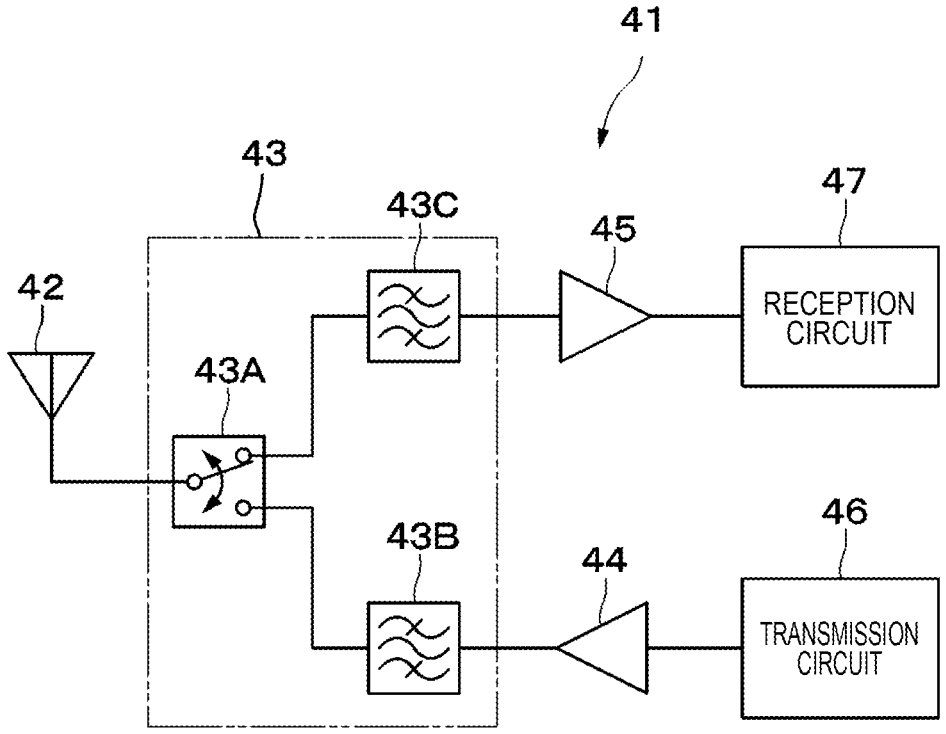
FIG. 12 is a block diagram of a communication device according to a fourth embodiment of the present disclosure.

A fourth embodiment of the present disclosure will be described below with reference to FIG. 12. The fourth embodiment is featured in that a communication device is constituted using the resonator parallel-coupled filter. In the fourth embodiment, the same constituent elements as those in the first embodiment are denoted by the same reference signs, and the description of those constituent elements is omitted.

A communication device 41 according to the fourth embodiment includes an antenna 42, an antenna duplexer 43, a power amplifier 44, a low-noise amplifier 45, a transmission circuit 46, and a reception circuit 47. The transmission circuit 46 is connected to the antenna 42 through the power amplifier 44 and the antenna duplexer 43. The reception circuit 47 is connected to the antenna 42 through the low-noise amplifier 45 and the antenna duplexer 43.

The antenna duplexer 43 includes a changeover switch 43A and two band pass filters 43B and 43C. The changeover switch 43A selectively connects one of the transmission circuit 46 and the reception circuit 47 to the antenna 42. The changeover switch 43A selectively switches between a transmission state and a reception state of the communication device 41. The band pass filter 43B on a transmission side is connected between the changeover switch 43A and the power amplifier 44. The band pass filter 43C on a reception side is connected between the changeover switch 43A and the low-noise amplifier 45. The band pass filters 43B and 43C are each constituted by, for example, the resonator parallel-coupled filter 1 according to the first embodiment. Instead, the band pass filters 43B and 43C may be each constituted by one of the resonator parallel-coupled filter 21 and 31 according to the second and third embodiments.

Thus, in the fourth embodiment with the above-described configuration, since the band pass filters 43B and 43C are each constituted by, for example, the resonator parallel-coupled filter 1 according to the first embodiment, the sizes of the band pass filters 43B and 43C can be reduced. Hence a size of the communication device 41 can be reduced.

In the above-described embodiments, the linear conductors 10, 13 and 23 of the resonators 9, 12 and 22 are formed at the same position in the Z-axis direction (namely, between the insulating layers 4 and 5). The present disclosure is not limited to that case, and the linear conductors 10, 13 and 23 may be formed at different positions in the Z-axis direction.

Although, in the above-described embodiments, the linear conductors 10, 13 and 23 of the resonators 9, 12 and 22 are formed in a rectilinear shape, those linear conductors may be formed in a curved shape or a bent shape.

It is needless to say that the above-described embodiments are merely illustrative, and that the configurations in the different embodiments can be partly replaced or combined with each other.

The following examples are conceivable as forms of the resonator parallel-coupled filter and the communication device that are included in the above-described embodiments.

A first form resides in a resonator parallel-coupled filter including a dielectric substrate, ground conductors disposed respectively on a first surface and a second surface of the dielectric substrate, a first resonator including a linear conductor disposed inside the dielectric substrate, a second resonator including a linear conductor disposed inside the dielectric substrate, and a first input-output line and a second input-output line which connect the first resonator and the second resonator to external circuits and to which the first resonator and the second resonator are connected in parallel, wherein the linear conductor of the first resonator has a first end connected to the ground conductor on the first surface of the dielectric substrate through a first via, and a second end being open, the linear conductor of the second resonator has a first end connected to the ground conductor on the second surface of the dielectric substrate through a second via, and a second end being open, the first input-output line is connected to the ground conductor on one of the first surface and the second surface of the dielectric substrate through a third via and is coupled to the first end of the linear conductor of the first resonator and the first end of the linear conductor of the second resonator, and the second input output line is opposed to the second end of the linear conductor of the first resonator and the second end of the linear conductor of the second resonator and is coupled to the second end of the linear conductor of the first resonator and the second end of the linear conductor of the second resonator.

With the above-described feature, each of the first resonator and the second resonator operates as a ¼-wavelength resonator in which the first end is connected to the ground conductor and the second end is left open. Furthermore, the first input-output line is short-circuited to the ground conductor through the third via. The third via for the first input-output line is coupled to the first via for the first resonator and the second via for the second resonator. In this respect, the first via for the first resonator and the second via for the second resonator extend in opposite directions with respect to the thickness direction of the dielectric substrate and are connected to the different ground conductors, respectively. Moreover, the second end of the first resonator and the second end of the second resonator are left open and are coupled to the second input-output line. Thus, the two ¼-wavelength resonators are connected in opposite phases between the first input-output line and the second input-output line, thus allowing radio frequency signals in a band around resonant frequencies of the two resonators to pass therethrough. In addition, a filter size can be reduced in comparison with the case of using a ½-wavelength resonator.

According to a second form, the resonator parallel-coupled filter according to the first form further includes a third resonator including a linear conductor disposed inside the dielectric substrate, the third resonator being coupled to one of the first resonator and the second resonator. With that feature, the so-called Cul-de-Sac coupled filter can be constituted.

According to a third form, in the first form, the third via is a penetration via penetrating through the dielectric substrate in a thickness direction, and the first input-output line is connected to the ground conductor on one of the first surface and the second surface of the dielectric substrate through the penetration via.

With the above-described feature, the first input-output line connected to the external circuit can be arranged on, for example, the first surface or the second surface of the dielectric substrate. Accordingly, even when various signal lines are formed inside the dielectric substrate, those signal lines do not interfere with the first input-output line. As a result, a degree of freedom in connection to the external circuit can be increased.

A communication device according to a fourth form includes the resonator parallel-coupled filter according to any one of the first to third forms.

1, 21, 31 resonator parallel-coupled filter
2 dielectric substrate
2A first surface
2B second surface
7, 8 ground conductor
9 resonator (first resonator)
12 resonator (second resonator)
10, 13, 23 linear conductor
10A, 13A, 23A first end
10B, 13B, 23B second end
11 via (first via)
14 via (second via)
15, 17, 32 input-output line
16 via (third via)
22 resonator (third resonator)
24 via (fourth via)
33 penetration via (third via)
41 communication device
43B, 43C band pass filter

The invention claimed is:

1. A resonator parallel-coupled filter comprising:

a dielectric substrate;

a first ground conductor disposed on a first surface of the dielectric substrate and a second ground conductor disposed on a second surface of the dielectric substrate;

a first resonator including a first linear conductor disposed inside the dielectric substrate;

a second resonator including a second linear conductor disposed inside the dielectric substrate; and a first input-output line and a second input-output line connecting the first resonator and the second resonator to external circuits, wherein the first resonator and the second resonator are connected in parallel between the first input-output line and the second input-output line, wherein the first linear conductor has a first end connected to the first ground conductor on the first surface of the dielectric substrate through a first via, and a second end being open, the second linear conductor has a first end connected to the second ground conductor on the second surface of the dielectric substrate through a second via, and a second end being open, the first input-output line is connected to the second ground conductor on one of the first surface and the second surface of the dielectric substrate through a third via and is coupled to the first end of the first linear conductor and the first end of the second linear conductor, and the second input-output line is opposed to the second end of the first linear conductor and the second end of the second linear conductor and is coupled to the second end of the first linear conductor and the second end of the second linear conductor.

2. The resonator parallel-coupled filter according to claim 1, further comprising a third resonator including a third linear conductor disposed inside the dielectric substrate, the third resonator being coupled to one of the first resonator and the second resonator.

3. A communication device including the resonator parallel-coupled filter according to claim 2.

4. The resonator parallel-coupled filter according to claim 1, wherein the third via is a penetration via penetrating through the dielectric substrate in a thickness direction, and the first input-output line is connected to the first ground conductor or the second ground conductor through the penetration via.

5. A communication device including the resonator parallel-coupled filter according to claim 4.

6. A communication device including the resonator parallel-coupled filter according to claim 1.

* * * * *